US007965260B2

(12) United States Patent
Sim

(10) Patent No.: US 7,965,260 B2
(45) Date of Patent: Jun. 21, 2011

(54) PLASMA DISPLAY APPARATUS

(75) Inventor: Sooseok Sim, Gumi-si (KR)

(73) Assignee: LG Electronics Inc., Seoul (KR)

( * ) Notice: Subject to any disclaimer, the term of this patent is extended or adjusted under 35 U.S.C. 154(b) by 1139 days.

(21) Appl. No.: 11/714,227

(22) Filed: Mar. 6, 2007

(65) Prior Publication Data

US 2007/0210989 A1 Sep. 13, 2007

(30) Foreign Application Priority Data

Mar. 7, 2006 (KR) ..... 10-2006-0021502

(51) Int. Cl.
*G09G 3/28* (2006.01)

(52) U.S. Cl. ..... 345/63; 345/60; 345/68

(58) Field of Classification Search ..... 345/60
See application file for complete search history.

(56) References Cited

U.S. PATENT DOCUMENTS

| | | | | |
|---|---|---|---|---|
| 6,124,849 | A * | 9/2000 | Ito et al. | 345/204 |
| 7,053,559 | B2 * | 5/2006 | Kim et al. | 315/169.3 |
| 2001/0020923 | A1 * | 9/2001 | Homma | 345/60 |
| 2002/0008680 | A1 * | 1/2002 | Hashimoto et al. | 345/63 |
| 2002/0097201 | A1 * | 7/2002 | Yamamoto et al. | 345/60 |
| 2003/0122738 | A1 * | 7/2003 | Lee | 345/60 |
| 2003/0122742 | A1 * | 7/2003 | Akiba | 345/63 |
| 2003/0169216 | A1 * | 9/2003 | Chung et al. | 345/60 |
| 2004/0189569 | A1 * | 9/2004 | Ochi | 345/89 |
| 2004/0196233 | A1 * | 10/2004 | Shimizu | 345/89 |
| 2005/0073478 | A1 * | 4/2005 | Chang et al. | 345/60 |
| 2005/0093780 | A1 * | 5/2005 | Jeong | 345/63 |
| 2006/0001373 | A1 * | 1/2006 | Nonomura et al. | 313/582 |
| 2006/0007065 | A1 * | 1/2006 | Kosaka | 345/63 |
| 2006/0125725 | A1 * | 6/2006 | Yang et al. | 345/67 |
| 2006/0181487 | A1 * | 8/2006 | Kong et al. | 345/60 |
| 2006/0227253 | A1 * | 10/2006 | Kim | 348/739 |
| 2007/0285352 | A1 * | 12/2007 | Hwang et al. | 345/60 |

FOREIGN PATENT DOCUMENTS

| | | | |
|---|---|---|---|
| EP | 982708 | A1 * | 3/2000 |
| KR | 10-2006-0011036 | A | 2/2006 |

OTHER PUBLICATIONS

Saito et al, "The 121-contiguous-subfield addressing of high Xe-content PDPs", Apr. 2005, Journal of the SID, vol. 13/1, pp. 25-32.*

* cited by examiner

*Primary Examiner* — Richard Hjerpe
*Assistant Examiner* — Dorothy Harris
(74) *Attorney, Agent, or Firm* — KED & Associates, LLP

(57) ABSTRACT

A plasma display apparatus is provided. The plasma display apparatus comprises a plasma display panel for displaying an image using a plasma discharge; and a driver for driving the plasma display panel by enabling a length of an address period of at least one of subfields of a frame to be different from that of an address period of other subfields.

20 Claims, 13 Drawing Sheets

(a)

(b)

PLASMA DISPLAY APPARATUS

This application claims the benefit of Korean Patent Application No. 10-2006-0021502 filed on Mar. 7, 2006, which is hereby incorporated by reference.

BACKGROUND

1. Field

This document relates to a plasma display apparatus.

2. Related Art

In general, a plasma display apparatus comprises a plasma display panel in which a plurality of electrodes is formed and a driver for driving an electrode of the plasma display panel.

The plasma display panel is formed with coupling of a front panel comprising a front substrate and a rear panel comprising a rear substrate.

A discharge cell is formed between the front substrate and the rear substrate.

The driver supplies a predetermined driving voltage from a plurality of subfields of a frame to a discharge cell of the plasma display panel. A discharge such as a reset discharge, an address discharge, and a sustain discharge is generated within a discharge cell of the plasma display panel by the driving voltage.

When a discharge generates within a discharge cell with the supply of a predetermined driving voltage, a discharge gas filled within the discharge cell generates high frequency light such as vacuum ultraviolet rays.

The high frequency light enables a phosphor formed within the discharge cell to emit light, and a phosphor layer generates visible rays, whereby an image is embodied.

In the plasma display apparatus, if a discharge is generated within a discharge cell of the plasma display panel, vibration generated by the discharge is transferred to a front substrate and a rear substrate. As the front substrate and the rear substrate are vibrated, noise generates in a relatively high level.

As vibration of the front substrate and the rear substrate is transferred to a heat radiating plate and a driving board disposed on a rear surface of the plasma display panel, noise generation is further increased.

Particularly, because one frame is formed using a plurality of subfields having a different length and thus an image is embodied, an interval between generation time points of discharges generating in each subfield changes, so that a frequency of a driving signal for generating a discharge changes. Accordingly, generating of noise further increases.

SUMMARY

An aspect of this document is to provide a plasma display apparatus for reducing noise generation by reducing the frequency change of a driving signal for generating a discharge within a discharge cell of a plasma display panel.

In an aspect, a plasma display apparatus comprising: a plasma display panel for displaying an image using a plasma discharge; and a driver for driving the plasma display panel by enabling a length of an address period of at least one of subfields of a frame to be different from that of an address period of other subfields.

In another aspect, a plasma display apparatus comprising: a plasma display panel for displaying an image using a plasma discharge; and a driver for driving the plasma display panel, wherein a frame comprises a first subfield and a second subfield comprising more sustain pulses than the first subfield; each sustain period of the first subfield and the second subfield comprises an idle period; and the driver drives the plasma display panel by enabling a length of an idle period of the first subfield to be different from that of an idle period of the second subfield.

Further features will be apparent from the following description, comprising the drawings, and the claims.

BRIEF DESCRIPTION OF THE DRAWINGS

The implementation of this document will be described in detail with reference to the following drawings in which like numerals refer to like elements.

DETAILED DESCRIPTION

Hereinafter, an implementation of this document will be described in detail with reference to the attached drawings.

Figure 1:
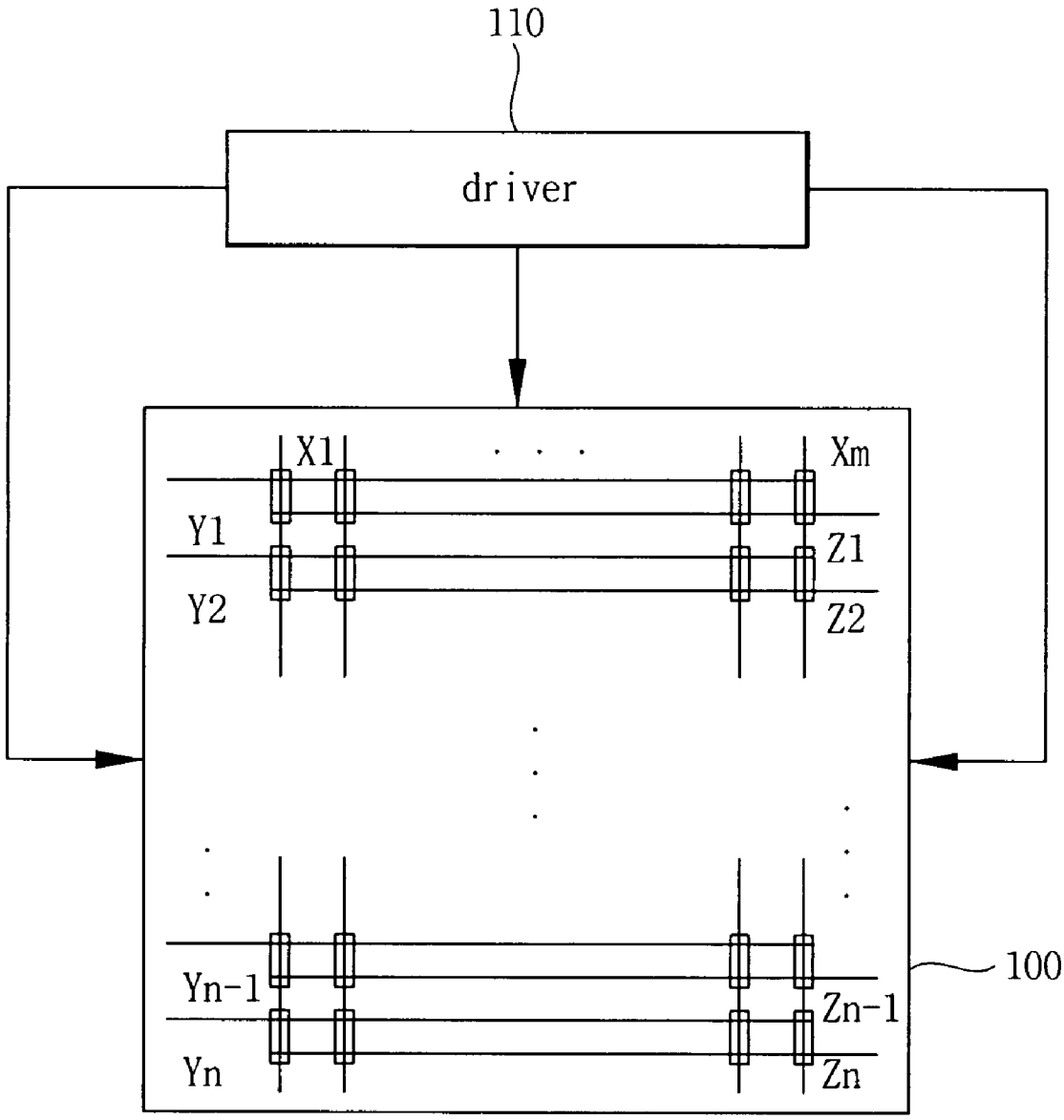
FIG. 1 is a diagram illustrating a configuration of a plasma display apparatus of this document.

FIG. 1 is a diagram illustrating a configuration of a plasma display apparatus of this document.

Referring to FIG. 1, the plasma display apparatus comprises a plasma display panel 100 and a driver 110.

The driver 110 drives the plasma display panel 100 by enabling a length of an address period of at least one of subfields of a frame to be different from that of an address period of other subfields.

Otherwise, the driver 110 drives the plasma display panel 100 by enabling a length of a sustain period of at least one of subfields of a frame to be approximately identical to that of a sustain period of other subfields.

For example, the driver 110 can drive an address electrode (X) using a method of supplying a data pulse to the address electrode (X) of the plasma display panel 100.

The driver 110 can drive a scan electrode (Y) using a method of supplying a reset voltage, a scan voltage, and a sustain voltage (Vs) to the scan electrode (Y) of the plasma display panel 100.

The driver 110 can drive a sustain electrode (Z) using a method of supplying a sustain bias voltage (Vz) and a sustain voltage (Vs) to the sustain electrode (Z) of the plasma display panel 100.

The driver 110, which is a major element of the plasma display apparatus in implementations of this document will be described in the following description.

The plasma display panel 100 displays an image using a plasma discharge.

Figure 2A:
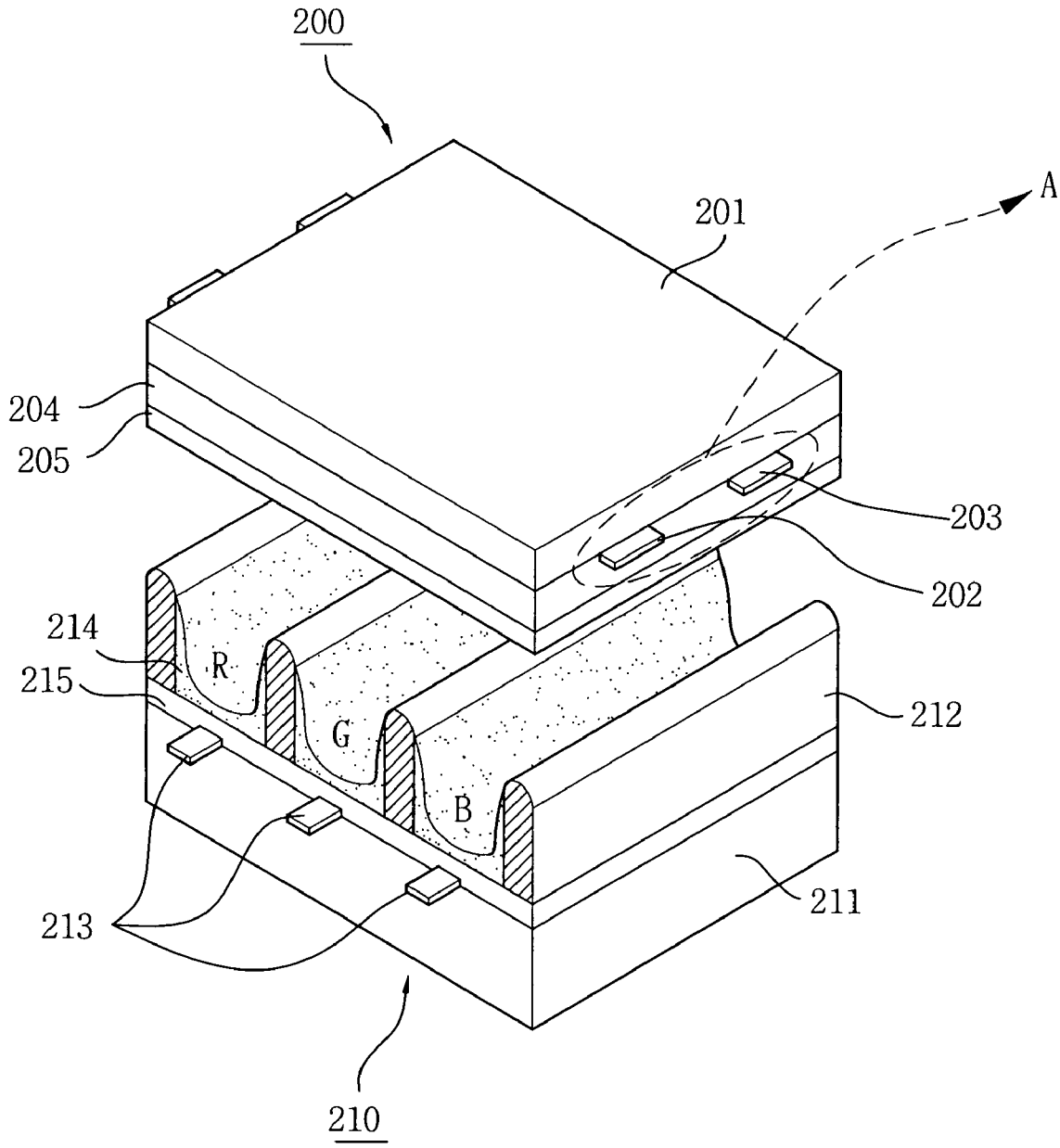
FIGS. 2*a* to 2*c* are views illustrating an example of a structure of a plasma display panel comprised in a plasma display apparatus of this document.
Figure 2B:
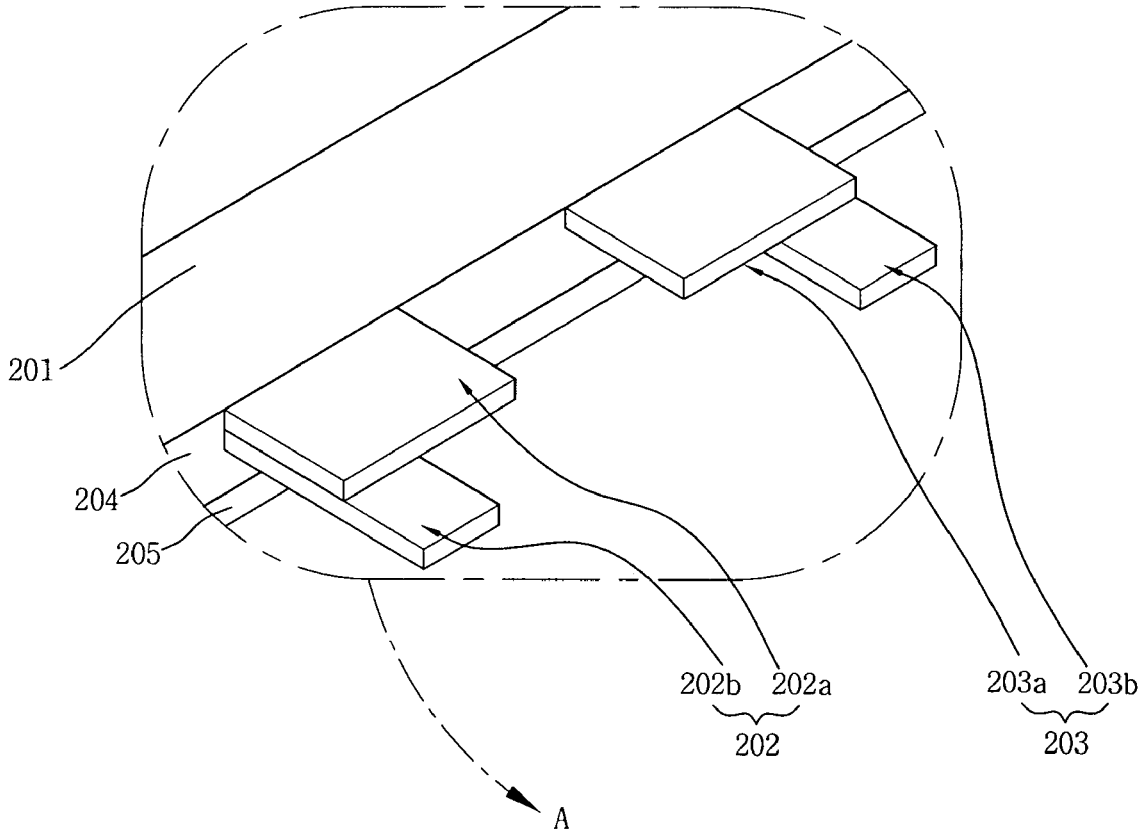
Figure 2C:
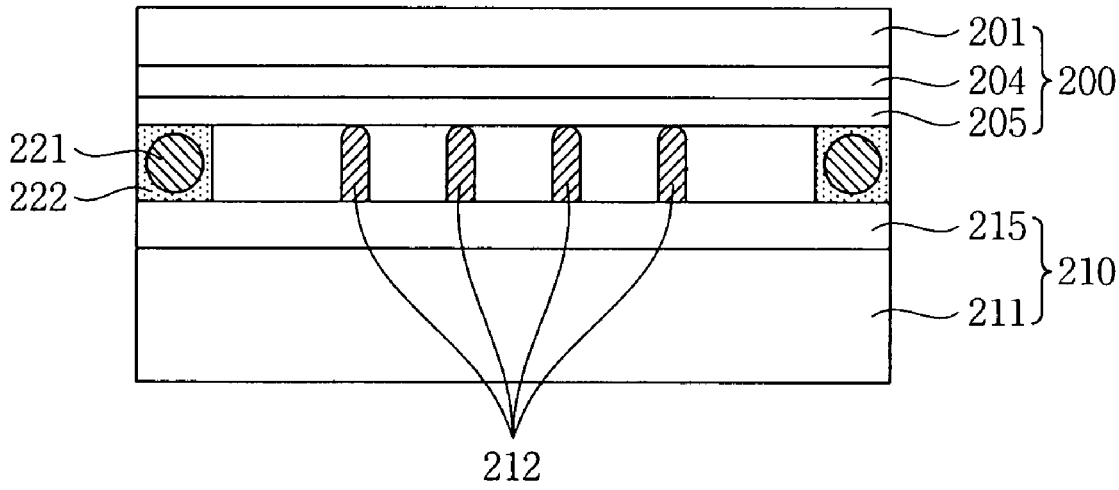

FIGS. 2*a* to 2*c* are views illustrating an example of a structure of a plasma display panel comprised in a plasma display apparatus of this document.

Referring to FIG. 2*a*, the plasma display panel is formed with coupling of a front panel 200 comprising a front substrate 201 in which an electrode, preferably, a scan electrode

202 (Y) and a sustain electrode 203 (Z) are formed and a rear panel 210 comprising a rear substrate 211 in which an electrode, preferably, an address electrode 213 (X) intersecting the scan electrode 202 (Y) and the sustain electrode 203 (Z) is formed.

An electrode, preferably, the scan electrode 202 (Y) and the sustain electrode 203 (Z) formed on the front substrate 201, generates a discharge in a discharge space, i.e. a discharge cell and sustains a discharge of the discharge cell.

A dielectric layer, preferably, an upper dielectric layer 204 is formed to cover the scan electrode 202 (Y) and the sustain electrode 203 (Z) on the front substrate 201 in which the scan electrode 202 (Y) and the sustain electrode 203 (Z) are formed.

The upper dielectric layer 204 limits a discharge current of the scan electrode 202 (Y) and the sustain electrode 203 (Z) and insulates the scan electrode 202 (Y) and the sustain electrode 203 (Z) from each other.

A protection layer 205 is formed on the upper dielectric layer 204 to facilitate a discharge condition. The protection layer 205 is formed using a method of depositing a material such as magnesium oxide (MgO) on the upper dielectric layer 204.

An electrode, preferably, the address electrode 213 (X) formed on the rear substrate 211 supplies data to the discharge cell.

A dielectric layer, preferably, a lower dielectric layer 215 is formed to cover the address electrode 213 (X) on the rear substrate 211 in which the address electrode 213 (X) is formed.

The lower dielectric layer 215 insulates address electrodes 213 (X) from each other.

A stripe type or well type barrier rib 212 is formed to partition a discharge space, i.e. a discharge cell on the lower dielectric layer 215. Accordingly, red color (R), green color (G), and blue color (B) discharge cells are formed between the front substrate 201 and the rear substrate 211.

A predetermined discharge gas is filled within the discharge cell partitioned by the barrier rib 212.

A phosphor layer 214 that emits visible light for displaying an image when an address discharge is performed is formed within the discharge cell partitioned by the barrier rib 212. For example, red color (R), green color (G), and blue color (B) phosphor layer are formed.

In the above-described plasma display panel, when a driving voltage is supplied to at least one of the scan electrode 202 (Y), the sustain electrode 203 (Z), and the address electrode 213 (X), a discharge generates within the discharge cell partitioned by the barrier rib 212.

Accordingly, vacuum ultraviolet rays are generated by a discharge gas filled within the discharge cell and are applied to the phosphor layer 214 formed within the discharge cell. Accordingly, a predetermined visible light generates in the phosphor layer 214 and is emitted to the outside through the front substrate 201 in which the upper dielectric layer 204 is formed, so that a predetermined image is displayed on an external surface of the front substrate 201.

FIG. 2*a* shows a case in which each of the scan electrode 202 (Y) and the sustain electrode 203 (Z) is formed in one layer, however at least one of the scan electrode 202 (Y) and the sustain electrode 203 (Z) may be formed in a plurality of layers, and this is described with reference to FIG. 2*b*.

Referring to FIG. 2*b*, each of the scan electrode 202 (Y) and the sustain electrode 203 (Z) is formed in two layers.

Particularly, in consideration of light transmittance and electrical conductivity, in order to emit light generated within the discharge cell to the outside and secure driving efficiency, it is preferable that the scan electrode 202 (Y) and the sustain electrode 203 (Z) comprise bus electrodes 202*b* and 203*b* made of opaque silver (Ag) and transparent electrodes 202*a* and 203*a* made of transparent Indium Tin Oxide (ITO).

The reason why the scan electrode 202 (Y) and the sustain electrode 203 (Z) comprise the transparent electrodes 202*a* and 203*a* is to effectively emit visible light generated within the discharge cell to the outside of the plasma display panel.

The reason why the scan electrode 202 (Y) and the sustain electrode 203 (Z) comprise the bus electrodes 202*b* and 203*b* is to compensate low electrical conductivity of the transparent electrodes 202*a* and 203*a* that may cause the decrease of driving efficiency because driving efficiency may decrease due to relatively low electrical conductivity of the transparent electrodes 202*a* and 203*a* when the scan electrode 202 (Y) and the sustain electrode 203 (Z) comprise only the transparent electrodes 202*a* and 203*a*.

FIGS. 2*a* and 2*b* show an example of a plasma display panel in implementations of this document, and this document is not limited to a plasma display panel having a structure of FIGS. 2*a* and 2*b*. For example, the plasma display panel of FIGS. 2*a* and 2*b* shows a case in which each of the upper dielectric layer 204 and the lower dielectric layer 215 is formed in one layer, however at least one of the upper dielectric layer 204 and the lower dielectric layer 215 may be formed in a plurality of layers.

FIG. 2*c* shows coupling of the plasma display panel of FIG. 2*a*.

When the front panel 200 and the rear panel 210 are coupled, the front panel 200 and the rear panel 210 are bent in an approaching direction of the front panel 200 and the rear panel 210. Accordingly, a gap generates between a central portion of the front panel 200 and the barrier rib 212, and thus noise due to vibration of the front panel 200 and the rear panel 210 generated upon a discharge further increases.

FIG. 2*c* shows that a seal 222 between the front panel 200 and the rear panel 210 is added to the plasma display panel of FIG. 2*a*, and that beads 221 are inserted into the seal 222.

By inserting the beads 221 into edge portions of the front panel 200 and the rear panel 210 and coupling the front panel 200 and the rear panel 210 with the seal 222, the front panel 200 and the rear panel 210 can be coupled with a uniform gap. Accordingly, noise generation of the plasma display panel can be reduced. The beads 221 may use glass beads, and the seal 222 may use frit glass.

As shown in FIG. 1, the driver 110 embodies an image on a screen of the plasma display panel 100 by driving the plasma display panel 100 having the above-described configuration with a frame comprising a plurality of subfields.

The frame is described in detail hereinafter.

A frame for embodying a gray level of an image is divided into several subfields having different light emitting number of times. Further, although not shown, each subfield is divided again into a reset period for initializing entire discharge cells, an address period for selecting a discharge cell to be discharged, and a sustain period for embodying a gray level according to the discharge number of times.

For example, when an image is displayed with 256 gray levels, a frame period (16.67 ms) corresponding to 1/60 second is divided into, for example, 8 subfields (SF1 to SF8), and each of 8 sub-fields (SF1 to SF8) is subdivided into a reset period, an address period, and a sustain period.

By adjusting the number of sustain pulses supplied in a sustain period, a gray level weight of the corresponding subfield can be set. That is, a predetermined gray level weight can be provided in each subfield using a sustain period. For example, a gray level weight of each subfield can be determined so that a gray level weight of each subfield increases with a ratio of $2^n$ (n=0, 1, 2, 3, 4, 5, 6, 7) using a method of setting a gray level weight of a first subfield to 20 and a gray level weight of a second subfield to 21. By adjusting the number of sustain pulses supplied in a sustain period of each subfield according to a gray level weight in each subfield, a gray level of various images can be embodied.

A plurality of frames embodies an image of 1 second. For example, 60 frames can be used to display an image of 1 second.

Unlike a case in which a frame comprises 8 subfields, the number of subfields constituting a frame can be variously changed. For example, a frame may comprise 12 subfields or 10 subfields.

A picture quality of an image embodied by a plasma display apparatus for embodying a gray level of an image with the frame can be determined according to the number of subfields comprised in the frame. That is, if the number of subfields comprised in the frame is 12, 212 image gray levels can be embodied, and if the number of subfields comprised in the frame is 8, 28 image gray levels can be embodied.

Figure 3A:
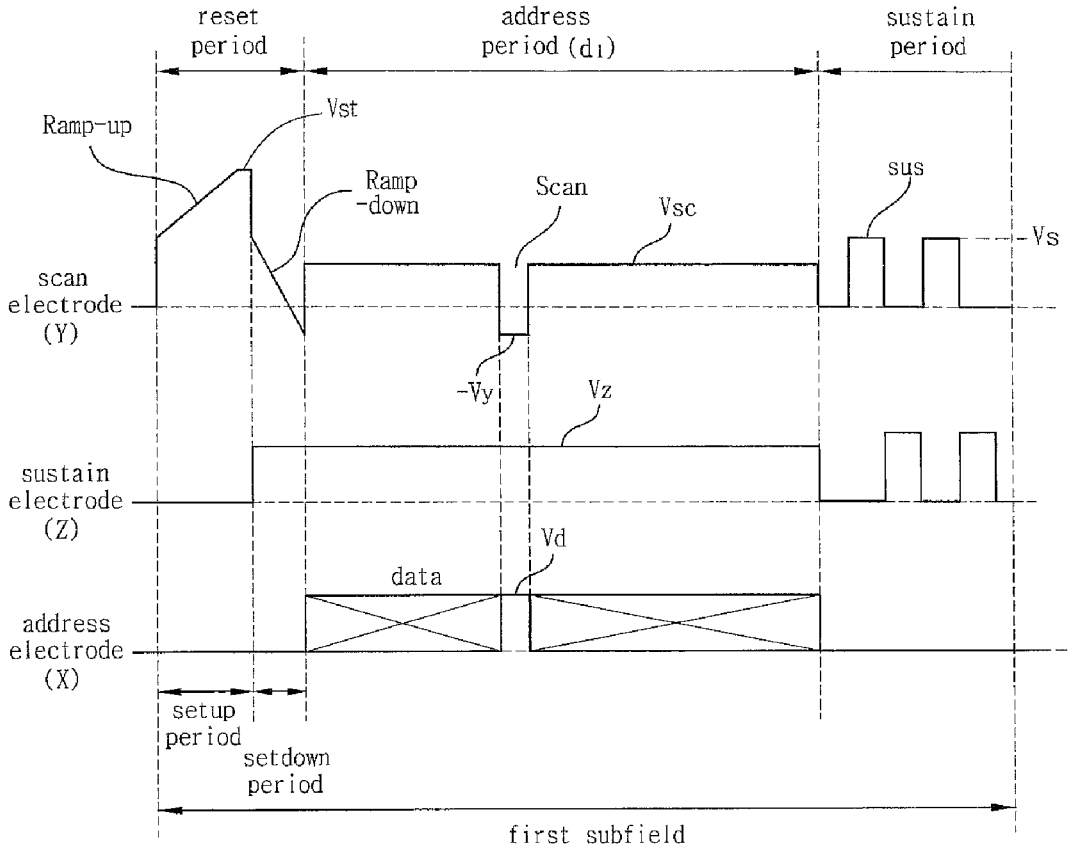
FIGS. 3*a* to 3*d* are diagrams illustrating an operation of a plasma display apparatus of this document.
Figure 3B:
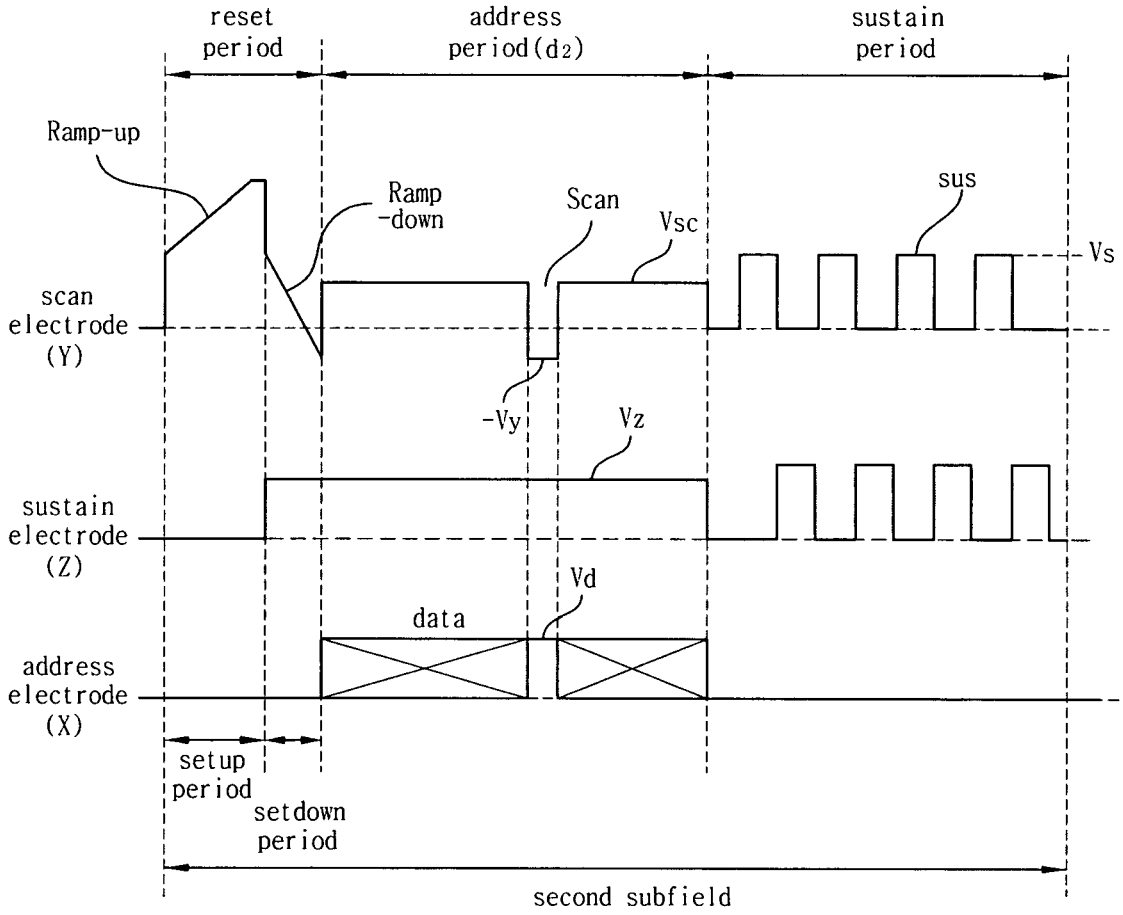

FIGS. 3*a* and 3*b* are diagrams illustrating an operation of a plasma display apparatus of this document.

Referring to FIG. 3*a*, the driver 110 of FIG. 1 supplies a ramp-up waveform in which a voltage gradually rises to the scan electrode Y in a setup period of a reset period for initializing in the first subfield of a plurality of subfields comprised in the frame. The ramp-up waveform rises to a maximum setup voltage (Vst).

A weak dark discharge, i.e. a setup discharge is generated within a discharge cell by the ramp-up waveform. Some wall charges are stacked within a discharge cell by the setup discharge.

Further, in a setdown period after a setup period, after a ramp-up waveform is supplied to the scan electrode (Y), a ramp-down waveform in which a voltage gradually falls from a predetermined positive voltage lower than a peak voltage of the ramp-up waveform is supplied.

Accordingly, a feeble erase discharge, i.e. a setdown discharge generates within a discharge cell. By the setdown discharge, a part of wall charges stacked within the discharge cell is erased by a previous setup discharge, and wall charges for stably generating an address discharge uniformly remain within the discharge cell.

In an address period for addressing after a reset period comprising the setup period and the setdown period, a negative scan pulse (Scan) of a scan reference voltage (Vsc) and a scan voltage (−Vy) falling from the scan reference voltage (Vsc) is supplied to the scan electrode (Y)

A length of an address period in the first subfield is 'd1'.

When a scan voltage (−Vy) of a negative scan pulse is supplied to the scan electrode (Y), a voltage of a data pulse, i.e. a data voltage (Vd) is supplied to an address electrode (X) corresponding to the scan electrode (Y).

Further, in order to prevent an erroneous discharge from generating due to interference of the sustain electrode (Z) in an address period, a sustain bias voltage (Vz) is supplied to the sustain electrode (Z).

In the address period, as a wall voltage generated by wall charges generated in a reset period is added to a voltage difference between a voltage (−Vy) of a negative scan pulse and a voltage (Vd) of a data pulse, an address discharge is generated within a discharge cell to which a voltage (Vd) of a data pulse is applied.

When a sustain voltage (Vs) of a sustain pulse is applied within the discharge cell in which the address discharge is generated, wall charges for generating a discharge are formed.

In a sustain period after the address period, in the driver 110, a voltage of a sustain pulse (SUS), i.e. a sustain voltage (Vs) is supplied to the scan electrode (Y) or the sustain electrode (Z).

In the discharge cell in which the address discharge is generated, as a wall voltage within the discharge cell and a sustain voltage (Vs) of the sustain pulse (SUS) are added, whenever a sustain pulse (SUS) is supplied, a sustain discharge, i.e. a display discharge generates between the scan electrode (Y) and the sustain electrode (Z). Accordingly, a predetermined image is embodied on a plasma display panel.

Referring to FIG. 3*b*, the driver 110 of FIG. 1 drives the plasma display panel 100 by enabling a length of an address period of the second subfield to be different from a length of an address period of the first subfield of FIG. 3*a*. Description of FIG. 3*b* substantially identical to that of FIG. 3*a* will be omitted.

For example, a length of an address period of the first subfield of FIG. 3*a* is 'd1', and a length of an address period of a second subfield of FIG. 3*b* is 'd2'.

A gray level weight of the first subfield of FIG. 3*a* is smaller than a gray level weight of the second subfield of FIG. 3*b*, and a length (d1) of an address period of the first subfield is longer than a length (d2) of an address period of the second subfield.

A total length of the first subfield of FIG. 3*a* is a total length of a reset period, an address period, and a sustain period, and a total length of the second subfield is a total length of a reset period, an address period, and a sustain period. The driver 110 enables lengths of the first subfield and the second subfield to be approximately identical.

Figure 3C:
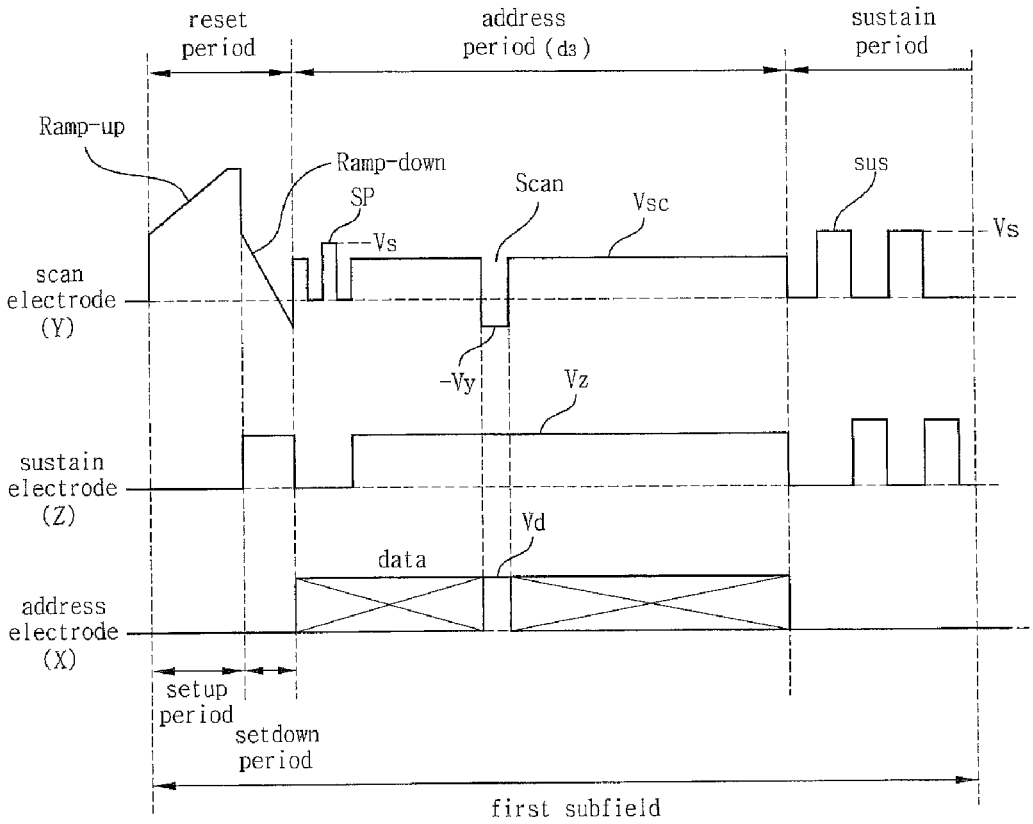
Figure 3D:
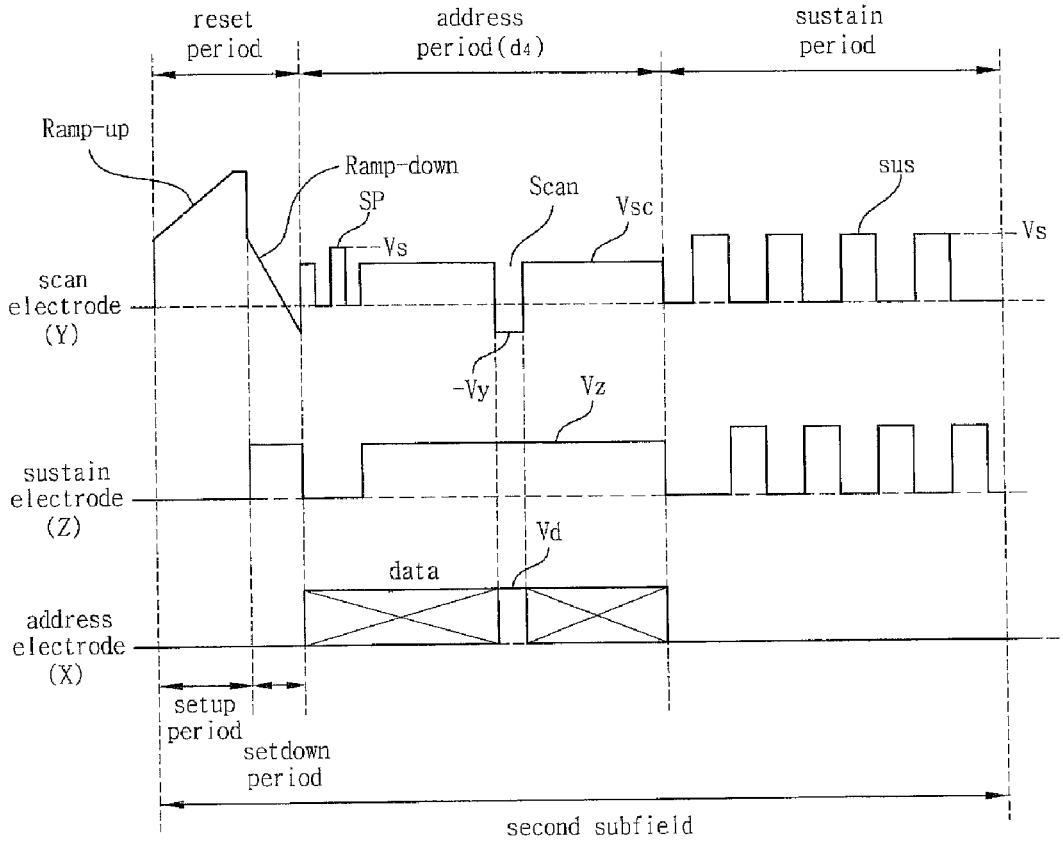

FIGS. 3*c* and 3*d* are diagrams illustrating another operation of a plasma display apparatus of this document.

As shown in FIGS. 3*c* and 3*d*, in an initial subfield (for example, a first subfield to a third subfield) having few sustain pulses and a low gray level weight, between a reset period and an address period, specifically, between a reset pulse and a scan pulse, a positive safe pulse (SP) is applied. The positive safe pulse (SP) forms a negative wall charge in the scan electrode (Y).

As the positive safe pulses (SP) are applied to the scan electrode (Y) in which positive wall charges are formed during a setdown period, negative wall charges are formed. Accordingly, an address discharge may stably generate, and a period of a subfield can be extended in an initial subfield (for example, a first subfield) having a low gray level weight.

A voltage level of the safe pulse (SP) is substantially identical to that of a sustain pulse, and a ground voltage is applied to the scan electrode (Y) before the safe pulse (SP) is applied. The safe pulse (SP) is applied at least two times between the reset pulse and the scan pulse.

While the safe pulse (SP) is applied to the scan electrode (Y), a ground level of voltage is applied to the sustain electrode (Z). Accordingly, an application effect of the safe pulse can be stably secured.

In FIGS. 3*c* and 3*d*, a width of the first scan pulse of the first subfield can be larger than that of the second scan pulse of the second subfield. A width of the second scan pulse is 45% to 75% of the first scan pulse width, preferably, 60% to 70%. It is not necessary that the first subfield and the second subfield are not adjacently positioned to each other. Accordingly, by adjusting a width of a scan pulse applied in an address period d3, d4, a length of an address period d3, d4 can be adjusted.

The address periods d3 and d4 as shown in FIGS. 3*c* and 3*d* refer to the address periods of the first and second sub fields, respectively.

Further, an interval between scan pulses applied in an address period of the first subfield can be differently adjusted from that between scan pulses applied in an address period of the second subfield. That is, by differently adjusting an interval between scan pulses, lengths between subfields can be approximately identical, and an interval between scan pulses in the first subfield can be larger than that between scan pulses in the second subfield.

Particularly, in the driver 110, it is preferable that lengths of address periods of entire subfields of the frame are differently set from each other, and this is described with reference to FIG. 4.

Figure 4:
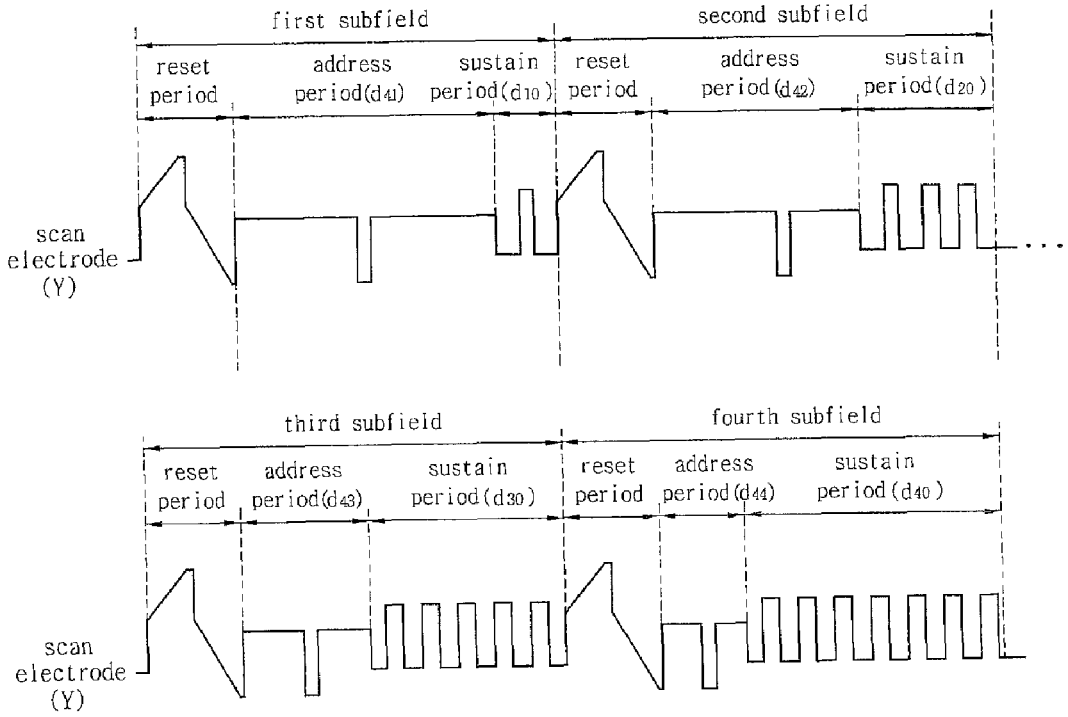
FIG. 4 is a diagram illustrating another operation of a plasma display apparatus of this document.

FIG. 4 is a diagram illustrating another operation of a plasma display apparatus of this document.

Referring to FIG. 4, when a frame comprises total 4 subfields, i.e. a first, second, third, and fourth subfields, lengths of address periods of the first, second, third, and fourth subfields are different from each other.

For example, a length of an address period of the first subfield is 'd41', and a length of an address period of the second subfield is 'd42', a length of an address period of the third subfield is 'd43', and a length of an address period of the fourth subfield is 'd44'.

A total length of entire subfields, i.e. the first, second, third, and fourth subfields is approximately identical.

For example, it is assumed that lengths of reset periods are identical in entire subfields, and a length of a sustain period of the first subfield is 'd10', a length of a sustain period of the second subfield is 'd20', a length of a sustain period of the third subfield is 'd30', and a length of a sustain period of the fourth subfield is 'd40'.

Then, according to a value of a gray level weight of each subfield, the following relationships are established.

$$d10<d20<d30<d40$$

$$(d41+d10)=(d42+d20)=(d43+d30)=(d44+d40)$$

A length (d44) of an address period of a subfield, i.e. the fourth subfield having the largest gray level weight among the first, second, third, and fourth subfields is the shortest, and a length (d41) of an address period of a subfield, i.e. the first subfield having the smallest gray level weight is the longest.

By the above-described setting, noise generation can be reduced, and this is described with reference to FIG. 5.

Figure 5:
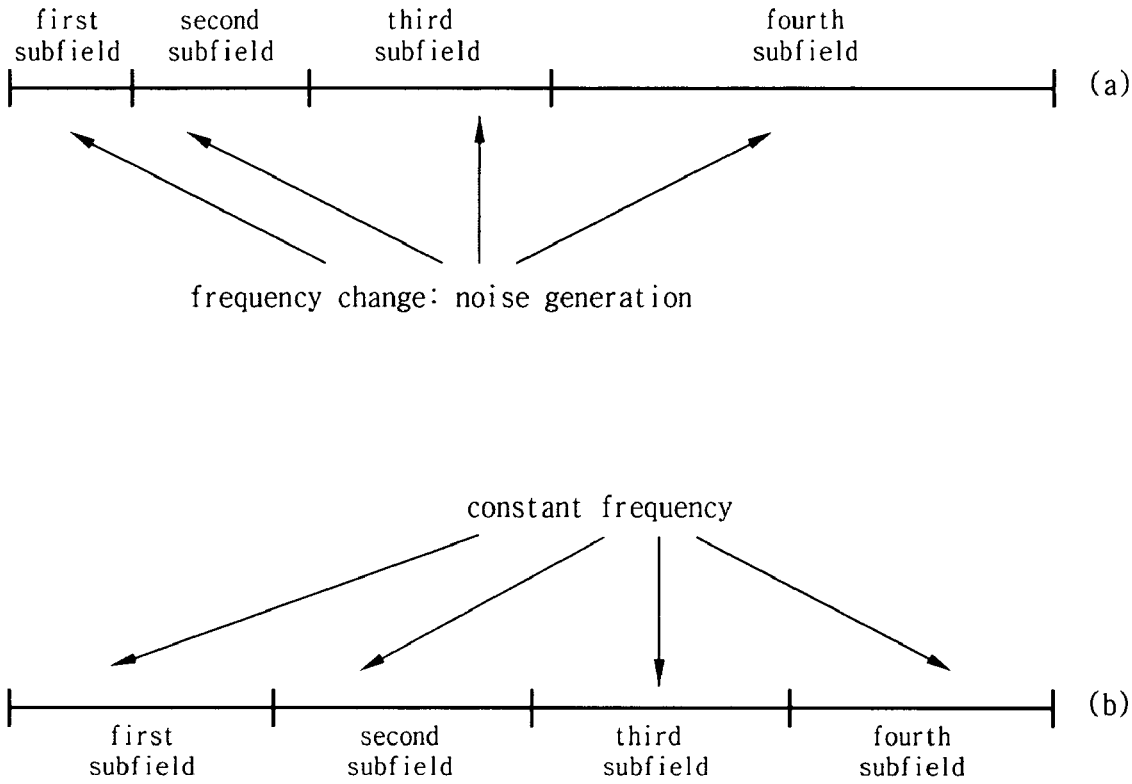
FIG. 5 is a diagram illustrating a method of reducing noise generation in a plasma display apparatus of this document.

FIG. 5 is a diagram illustrating a method of reducing noise generation in a plasma display apparatus of this document.

Referring to FIG. 5, as in FIG. 5(*a*), a frame comprises 4 subfields, i.e. a first, second, third, and fourth subfields, and lengths of address periods of the first, second, third, and fourth subfields are identical. Accordingly, when entire lengths of the first, second, third, and fourth subfields are different, a length of each subfield becomes different and thus a frequency of a driving signal changes.

When a discharge generates within a discharge cell of the plasma display panel, vibration generated by the discharge is transferred to the front substrate and the rear substrate. Accordingly, as the front substrate and the rear substrate vibrate, noise generates, and the noise further increases according to the change of a frequency of a driving signal.

As in FIG. 5(*b*), when a frame comprises 4 subfields, i.e. a first, second, third, and fourth subfields, and entire lengths of the first, second, third, and fourth subfields are approximately identical by adjusting lengths of address periods of the first, second, third, and fourth subfields, lengths of entire subfields becomes identical. Accordingly, a frequency of a driving signal is uniformly sustained without changing.

When a discharge generates within the discharge cell of the plasma display panel, vibration generated by the discharge is transferred to the front substrate and the rear substrate, and thus the front substrate and the rear substrate vibrate. Accordingly, noise generates, however as a frequency of a driving signal is uniformly sustained, noise is reduced.

In the above description, a method of reducing noise generation by adjusting a length of an address period is described, however it is possible to reduce noise generation by adjusting a length of a sustain period, and this is described.

Figure 6A:
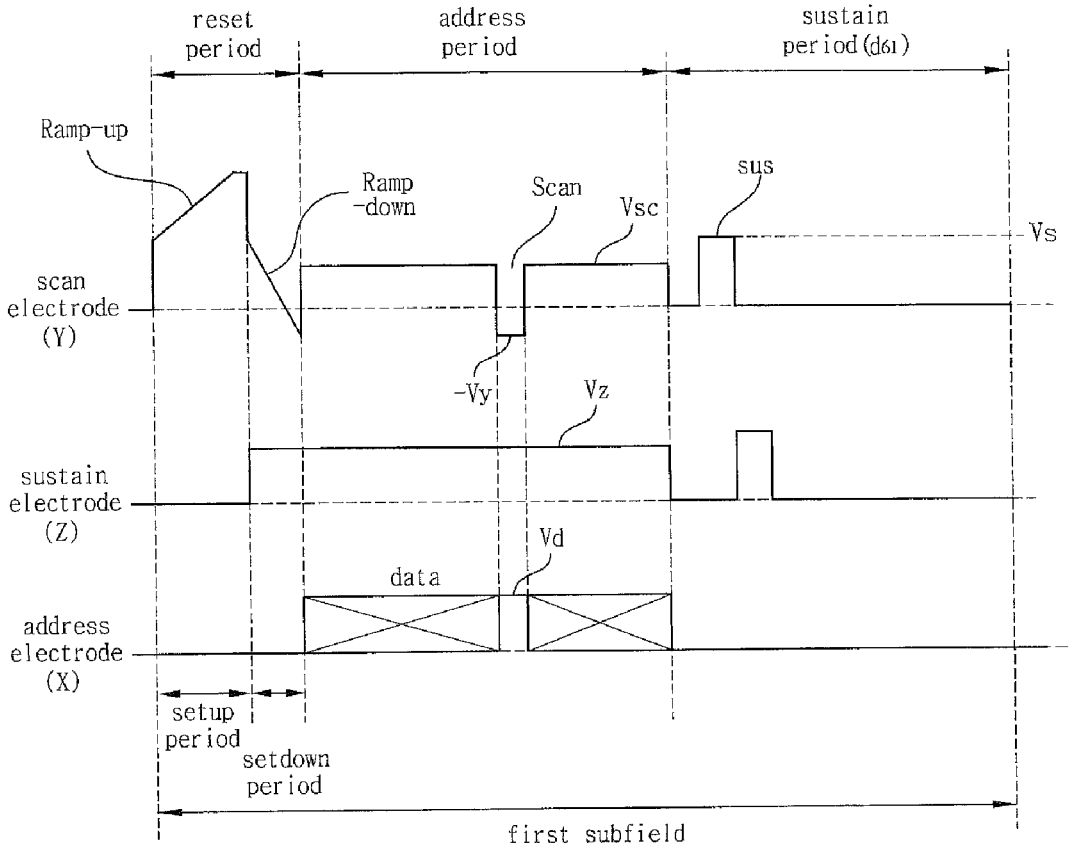
FIGS. 6*a* and 6*b* are diagrams illustrating a method of reducing noise generation by adjusting a length of a sustain period in a plasma display apparatus of this document.
Figure 6B:
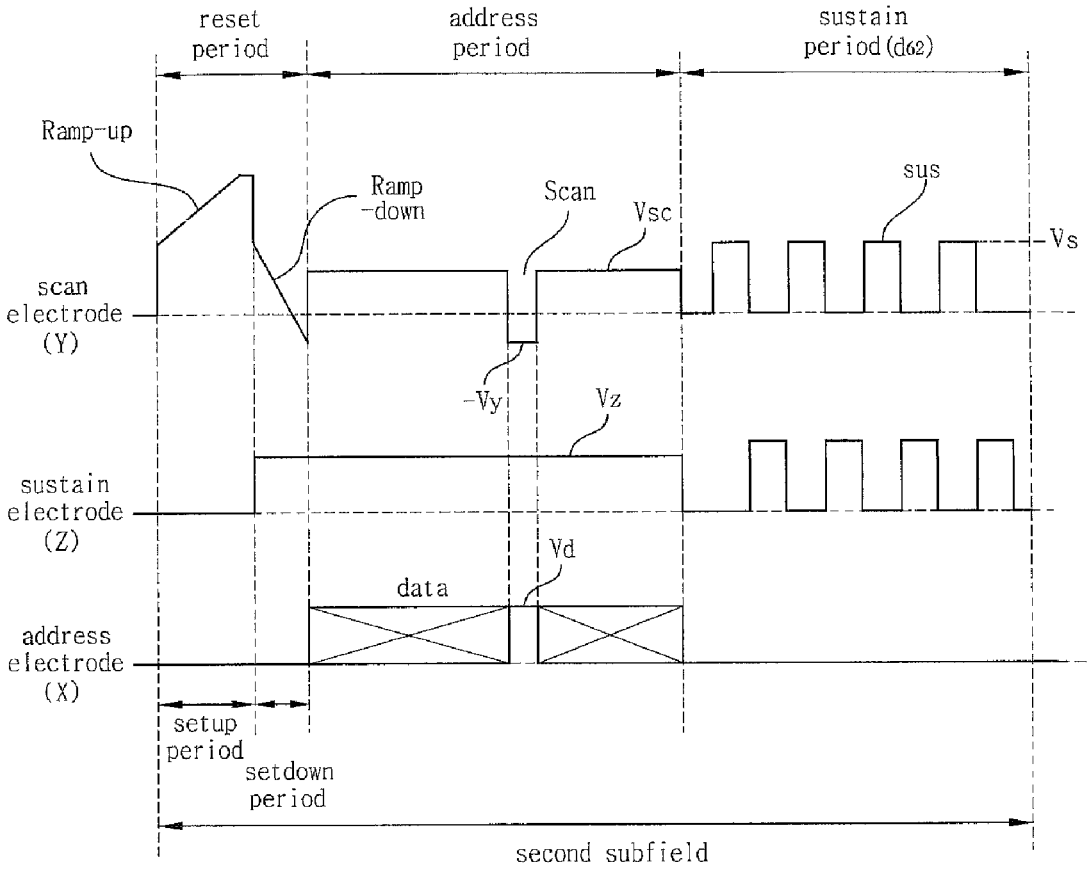

FIGS. 6*a* and 6*b* are diagrams illustrating a method of reducing noise generation by adjusting a length of a sustain period in a plasma display apparatus of this document. Description of FIGS. 6*a* and 6*b* substantially identical to that of FIGS. 3*a* and 3*b* will be omitted.

Referring to FIGS. 6*a* and 6*b*, a length (d61) of a sustain period for displaying an image of a first subfield having a relatively low gray level weight among subfields shown in FIG. 6*a* is approximately identical to a length (d62) of a sustain period of a second subfield having a relatively high gray level weight among subfields shown in FIG. 6*b*. A frame comprises the first subfield and the second subfield having sustain pulses more than the first subfield, and each sustain period of the first subfield and the second subfield further comprises an idle period, and a length of the idle period of the first subfield can be differently formed from that of the idle period of the second subfield.

FIGS. 6*a* and 6*b* exemplify the first subfield and the second subfield, but a length of a sustain period of at least one of subfields of the frame is approximately identical to that of a sustain period of other subfields.

It is preferable to comprise an idle period in a sustain period so that lengths of the sustain period of the first subfield and the second subfield having different gray level weights are identical, and this is described with reference to FIG. 7.

Figure 7:
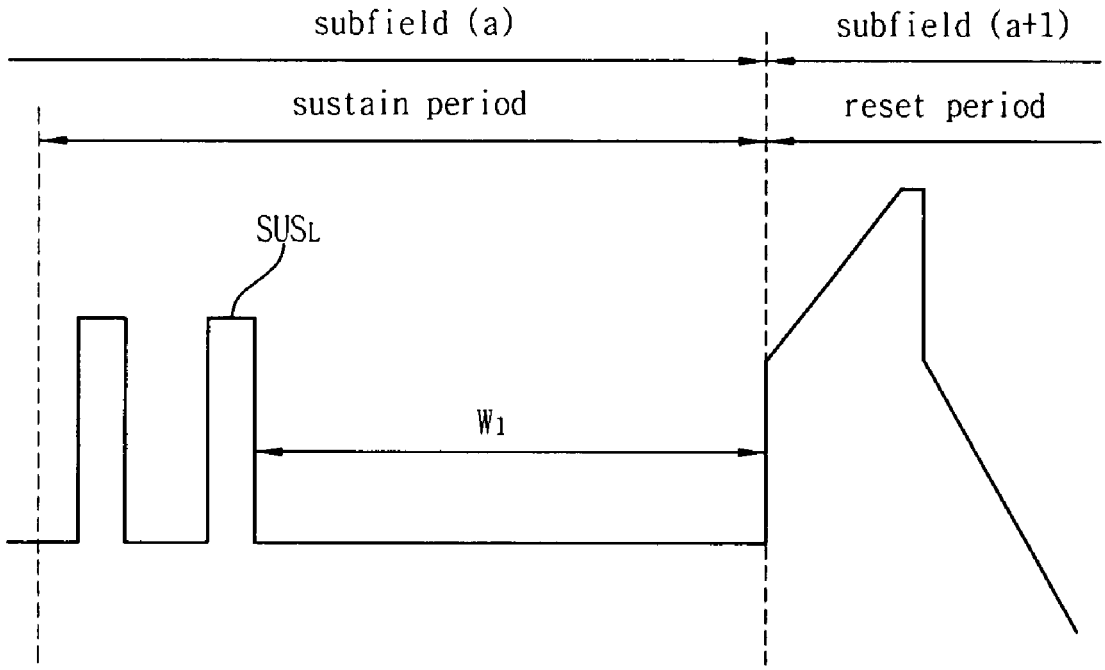
FIG. 7 is a diagram illustrating a method of enabling lengths of sustain periods of subfields having a different gray level weight to be approximately identical.
Figure 7:
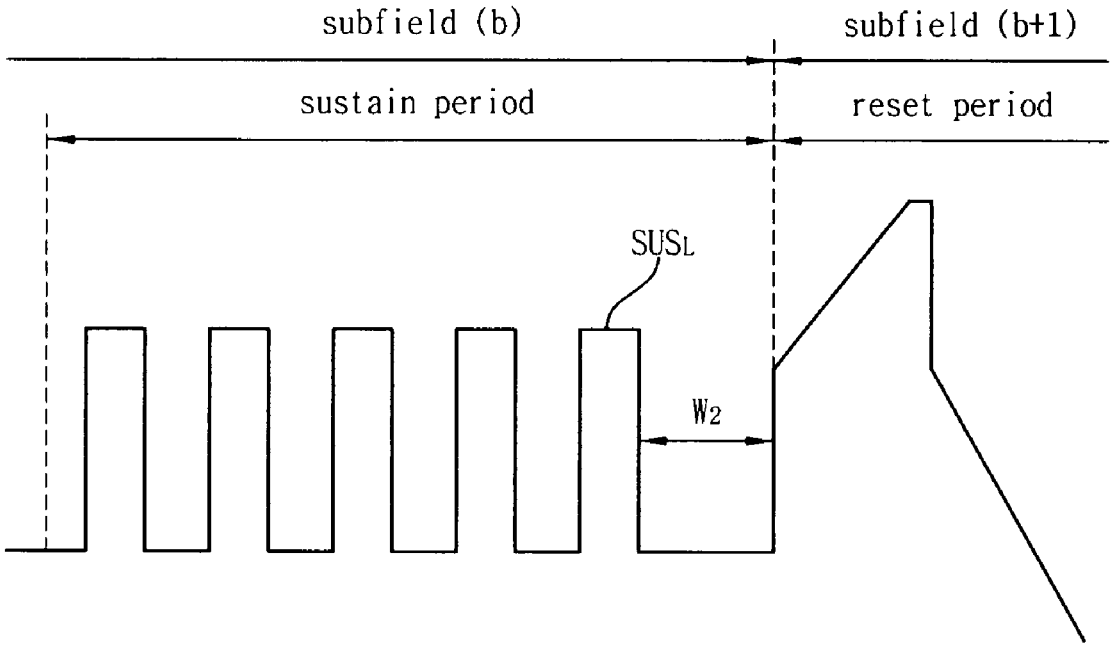

FIG. 7 is a diagram illustrating a method of enabling lengths of sustain periods of subfields having a different gray level weight to be identical.

Referring to FIG. 7, FIG. 7(*a*) shows a sustain period of a subfield (a). FIG. 7(*b*) shows a sustain period of a subfield (b) having a gray level weight larger than the subfield (a).

Each sustain period of the subfield (a) of FIG. 7(*a*) and the subfield (b) of FIG. 7(*b*) comprises an idle period.

The idle period is a period between a last subfield (SUSL) of sustain pulses supplied in a sustain period of a subfield and a reset period of a next subfield.

For example, an idle period of the subfield (a) of FIG. 7(*a*) is a period, i.e. a period (W1) between the last sustain pulse (SUSL) and a reset period of a subfield (a+1), which is a next subfield.

An idle period of the subfield (b) of FIG. 7(*b*) is a period, i.e. a period (W2) between the last sustain pulse (SUSL) and a reset period of a subfield (b+1), which is a next subfield.

Assuming that lengths of a reset period and an address period are identical in entire subfields, by enabling an idle period, i.e. a period (W1) comprised in the sustain period of the subfield (a) having a relatively small gray level weight as in FIG. 7(*a*) to be longer than an idle period, i.e. a period (W2) comprised in the sustain period of the subfield (b) having a relatively large gray level weight as in FIG. 7(*b*), entire lengths of the subfield (a) and the subfield (b) can be approximately identical.

Accordingly, generation of noise can be reduced.

In another implementation of this document, by adjusting a length of an address period and a length of a sustain period, lengths of subfields having a different gray level weight can be approximately identical.

As described above, in a plasma display apparatus of this document, by adjusting a length of an address period and/or a sustain period, lengths of subfields having a different gray level weight become approximately identical, so that generation of noise can be reduced.

Further, in another implementation of this document, by inserting beads when coupling a front panel and a rear panel, generation of noise can be reduced.

Other implementations are within the scope of the following claims.

What is claimed is:

1. A plasma display apparatus comprising:

a plasma display panel for displaying an image using a plasma discharge; and a driver configured to drive the plasma display panel by enabling a length of an address period of at least one of a plurality of subfields of a frame to be different from that of an address period of other subfields, wherein the frame includes a first and second subfields and wherein a total length of the first subfield and a total length of the second subfield are approximately identical.

2. The plasma display apparatus of claim 1, wherein the second subfield includes more sustain pulses than the first subfield; and a length of an address period of the first subfield is longer than that of an address period of the second subfield.

3. The plasma display apparatus of claim 2, wherein a positive safe pulse is applied to a scan electrode during the address period of the first subfield and between a reset pulse and a scan pulse of the first subfield.

4. The plasma display apparatus of claim 2, wherein a width of a first scan pulse in the address period of the first subfield is larger than that of a second scan pulse in the address period of the second subfield.

5. The plasma display apparatus of claim 4, wherein the width of the second scan pulse is 45% to 75% of that of the first scan pulse.

6. The plasma display apparatus of claim 5, wherein the width of the second scan pulse is 60% to 70% of that of the first scan pulse.

7. The plasma display apparatus of claim 2, wherein an interval between scan pulses applied to a plurality of scan electrodes in the address period of the first subfield is different from that between scan pulses applied to the plurality of scan electrodes in the address period of the second subfield.

8. The plasma display apparatus of claim 2, wherein a length of a sustain period of the first subfield is approximately identical to that of a sustain period of the second subfield.

9. The plasma display apparatus of claim 2, further comprising a seal between a front panel and a rear panel, wherein beads are inserted into the seal.

10. A plasma display apparatus comprising:

a plasma display panel for displaying an image using a plasma discharge; and a driver configured to drive the plasma display panel, wherein a frame comprises a first subfield and a second subfield comprising more sustain pulses than the first subfield;

each sustain period of the first subfield and the second subfield comprises an idle period;

the driver drives the plasma display panel by enabling a length of an idle period of the first subfield to be different from that of an idle period of the second subfield;

a length of an address period of the first subfield is different from that of an address period of the second subfield;

a total length of the first subfield and a total length of the second subfield are approximately identical; and each of the first and second subfields of the frame includes a reset period, the address period, and the sustain period.

11. The plasma display apparatus of claim 10, wherein an idle period of the first subfield is longer than that of the second subfield.

12. The plasma display apparatus of claim 11, wherein the idle period is a period between a last sustain pulse of sustain pulses supplied in a sustain period of a subfield and a reset period of the next subfield.

13. The plasma display apparatus of claim 11, wherein a positive safe pulse is applied to a scan electrode during an address period and between a reset pulse and a scan pulse of the first subfield.

14. The plasma display apparatus of claim 11, wherein a width of a first scan pulse in the address period of the first subfield is larger than that of a second scan pulse in the address period of the second subfield.

15. The plasma display apparatus of claim 14, wherein the width of the second scan pulse is 45% to 75% of that of the first scan pulse.

16. The plasma display apparatus of claim 15, wherein the width of the second scan pulse is 60% to 70% of that of the first scan pulse.

17. The plasma display apparatus of claim 11, wherein an interval between scan pulses applied to a plurality of scan electrodes in the address period of the first subfield is different from that between scan pulses applied to a plurality of scan electrodes in the address period of the second subfield.

18. The plasma display apparatus of claim 11, further comprising a seal between a front panel and a rear panel, wherein beads are inserted into the seal.

19. The plasma display of claim 2, wherein a highest voltage level of the sustain pulses is greater than a highest voltage level of a scan pulse, and wherein the highest voltage level of the sustain pulses and the highest voltage level of the scan pulse are greater than a lowest voltage level of the sustain pulse.

20. The plasma display of claim 2, wherein a highest voltage level of a scan pulse is greater than a lowest voltage level of the sustain pulses, and wherein a lowest voltage level of the scan pulse is lower than the lowest voltage level of the sustain pulses.

* * * * *